United States Patent [19]

Chikata et al.

[11] 4,303,498

[45] Dec. 1, 1981

[54] PROCESS FOR MANUFACTURE OF SOLVENT FOR COAL LIQUEFACTION

[75] Inventors: Tsukasa Chikata; Yoshihiko Sunami; Keiichi Sasaki; Kunihiko Nishioka, all of Amagasaki, Japan

[73] Assignee: Sumitomo Metal Industries Limited, Osaka, Japan

[21] Appl. No.: 157,451

[22] Filed: Jun. 6, 1980

[30] Foreign Application Priority Data

Jun. 12, 1979 [JP] Japan ..... 54-74440
Jun. 12, 1979 [JP] Japan ..... 54-74442
Dec. 19, 1979 [JP] Japan ..... 54-166142

[51] Int. Cl.[3] ..... C10G 7/00; C10G 1/04
[52] U.S. Cl. ..... 208/93; 208/8 LE
[58] Field of Search ..... 204/93, 8 LE, 56, 144

[56] References Cited

U.S. PATENT DOCUMENTS 4,111,786 9/1978 Sugimura ..... 208/8 LE
4,179,352 12/1979 Effron ..... 208/8 LE
4,189,371 2/1980 Maa ..... 208/8 LE

*Primary Examiner*—T. M. Tufariello
*Attorney, Agent, or Firm*—Watson, Cole, Grindle & Watson

[57] ABSTRACT

A solvent useful in coal liquefaction is obtained by separating the heavy liquid resulting from coal liquefaction into a fraction boiling at temperatures of between 200° to 210° C., a fraction boiling at temperatures between 211° to 250° C., and a fraction boiling at not less than 250° C., subjecting the fraction boiling at between 211° C. to 250° C. to two hydrogenation treatments, mixing the hydrogenated product with the fraction boiling at between 200° to 210° C. which optionally has been hydrogenated to form a resultant mixture and mixing a portion of the resultant mixture with the fraction boiling at not less than 250° C. which has been optionally hydrogenated.

2 Claims, 3 Drawing Figures

PROCESS FOR MANUFACTURE OF SOLVENT FOR COAL LIQUEFACTION

BACKGROUND OF THE INVENTION

1. Field of the Invention

This invention relates to a process for the liquefaction of coal wherein the coal is initially contacted with solvent to form a slurry and the slurry is then hydrogenated, and more particularly to a process for the production of the solvent which can be used to form the initial of coal slurry.

2. Description of the Prior Art

The chemical treatment of coal, which is a solid material having a usually high molecular weight, to produce light and heavy oils, which are liquids having low molecular weights, by subjecting the coal to a hydrogenation treatment at elevated temperatures and pressures is well known. Such a process is known as coal liquefaction. Due to the fact that the coal is a solid and thus cannot be easily supplied in a continuous fashion and at a fixed flow volume to the high pressure treatment apparatus, which may be operating at pressures of about 200 kg/cm$^2$, the coal is usually first pulverized and then contacted with a suitable solvent so as to form a slurry. Such a slurry can more easily be supplied to the high pressure treatment apparatus in a controlled manner.

The utilized solvent must have an acceptable viscosity (such as that of a medium oil) and it must be capable of effectively dispersing the coal and forming a stable slurry (if a stable slurry is not formed and it easily separates into solid and liquid phases, the solid phase (coal powder) will settle in the pipes of the treatment apparatus and interfere with the continuous liquefaction operation). In addition, a suitable solvent will be able to uniformly disperse and stabilize the products emerging from the hydrogenation treatment apparatus. Finally, the solvent should have the capacity to donate hydrogen, thereby not only helping create the initial coal slurry but also help in achieving a complete hydrogenation of the coal in the high pressure treatment apparatus. In this latter regard, if the solvent has an insufficient ability to donate hydrogen for reaction with the coal in the high pressure treatment apparatus, either the amount of coal contained per unit of solvent added to the treatment apparatus must be reduced, or else additional amounts of hydrogen gas must be supplied to the high pressure treatment apparatus. The former alternative is of course quite uneconomical as far as the overall coal liquefaction process is concerned, and the latter is quite dangerous since the apparatus is usually operating at temperatures of 400° to 450° C. and pressures of 100 to 200 Kg/cm$^2$. Pursuing this latter alternative thus requires the use of very highly advanced processing techniques which would be desirable to avoid, if possible.

One conventionally used solvent for coal liquefaction is the heavy liquid which is generated in the coal liquefaction process, this heavy liquid being recirculated to contact new coal either in unmodified form or after having been modified by a single hydrogenation treatment. This heavy liquid has the proper viscosity and possesses a high affinity for coal and thus when mixed with finely pulverized coal it will create a stable coal slurry. However, the heavy liquid in unmodified form does not possess a sufficient ability to donate hydrogen to make it a totally suitable solvent.

In order to increase the ability of such heavy liquid to donate hydrogen, it can be subjected to a hydrogenation treatment. During this treatment hydrogen donating substances will be generated in the heavy liquid. However, the heavy liquid which results from coal liquefaction is a mixture of many components, some of which will not convert into hydrogen-donating substances and, in any event, the conditions under which the hydrogenation treatment takes place will cause a portion of the heavy liquid to break down into gases (methane and ethane). Thus, the yield of hydrogen-donating substances in the solvent will be at most 30%.

Methods so far suggested to the art for the liquefaction of coal, including that taught by JA-OS 1202/53 laid open for public inspection on Jan. 9, 1978, have not yet been proven to be economical, safe or operationally stable.

An object of this invention therefore is to provide a process for the liquefaction of coal by use of a solvent.

Another object of this invention is to provide a process for the production of a solvent for use in the liquefaction of coal.

Yet another object of this invention is to provide a process for the production, in high yields, of a solvent for use in the liquefaction of coal.

A further object of this invention is to provide a process for the production, in a large amount, of a solvent for use in the liquefaction of coal.

SUMMARY OF THE INVENTION

To provide from the heavy liquid originating in the coal liquefaction a hydrogen-donating substance such as tetralin capable of advantageously serving as a solvent for the coal liquefaction, the aforementioned heavy liquid is subjected to two rounds of a hydrogenation treatment according to the present invention. In the first round of the hydrogenation treatment, alkyl naphthalenes and other components of the heavy liquid are dealkylated into naphthalene. In the second round of the hydrogenation treatment, the naphthalene is hydrogenated into tetralin.

To obtain such a hydrogen-donating substance, the present invention fractionates the heavy liquid into a portion boiling at temperatures of less than 200° C., and then a portion boiling at temperatures of not less than 200° C. and subject the latter portion to two rounds of a hydrogenation treatment.

The inventors conducted studies wherein the portion boiling at temperatures of not less than 200° C. was divided into a fraction consisting preponderantly of tetralin and boiling at 200° to 210° C., a fraction consisting preponderantly of naphthalene and boiling at 211° to 230° C. and a fraction consisting preponderantly of methyl naphthalene and polycyclic aromatic compounds and boiling at temperatures of not less than 231° C., and these fractions were studied with respect to their properties.

The study revealed that the fraction boiling at 200° to 210° C. relatively abounds with a hydrogen-donating property and that, in the hydrogenating treatment, the fraction boiling at 211° to 230° C. is converted more readily in higher yields into the hydrogen-donating substance than any of the other fractions. When the fractions boiling at 200° to 210° C. and at 211° to 230° C. are subjected to the hydrogenation treatment and are mixed with each other and the resultant mixture is used as the solvent for coal liquefaction, the liquefaction of coal is greatly accelerated because both the components of the mixture abound with hydrogen-donating substances. However, since the amounts of the fractions boiling at 200° to 210° C. and at 211° to 230° C. to be obtained are relatively small, use of their mixture as the solvent for the coal liquefaction brings about a problem that the amount of the mixture proves insufficient for the required supply. The inventors continued a further study from various angles and consequently found that when the fraction boiling at temperatures of not less than 200° C. which is obtained in the coal liquefaction is subjected to the hydrogenation reaction, it is dealkylated to a point where the amount of the fraction boiling at 200° to 250° C. is notably increased. The aforementioned problem of insufficient supply can therefore be solved by first hydrogenating the heavy liquid produced by the coal liquefaction and fractionating it into a fraction boiling at 200° to 210° C. and a fraction boiling at 211° to 250° C., further hydrogenating the latter fraction, mixing the product of this second hydrogenation with the first fraction and using the resultant mixture, or else by separating from the portion boiling at temperatures of not less than 200° C. the fractions consisting preponderantly of naphthalene and methyl naphthalene respectively and boiling at 211° to 250° C. and subjecting these fractions to the second round of the hydrogenation treatment.

With due consideration of the fact that the heavy oil obtained by the liquefaction of coal is a mixture consisting of various components which manifest different chemical behaviors, a study was conducted by dividing the heavy oil into fractions defined by proper boiling points as boundaries and comparing the properties these fractions exhibited as solvents for the coal liquefaction. First, the heavy oil was divided across the boiling point 200° C. into two portions. A study of the two portions revealed that the portion boiling at temperatures of not less than 200° C. relatively abounded with a hydrogen-donating property and they were converted relatively easily in high yields by a hydrogenation treatment into hydrogen-donating substances, whereas the portion boiling at temperatures of less than 200° C. possessed virtually no hydrogen-donating property and could not be given any hydrogen-donating ability by a hydrogenation treatment. Of the portion of the heavy oil which boiled at temperatures of not less than 200° C., different fractions were subjected to a hydrogenation treatment and the respective products of a hydrogenation were experimentally used as solvents for coal liquefaction. The results indicated that by a hydrogenation treatment conducted under fixed conditions, the polycyclic aromatic substance lacking side chains such as of methyl group provided the coal liquefaction at a higher ratio than the polycyclic aromatic substance possessing such side chains. On the other hand, when these fractions were directly used, without undergoing a hydrogenation treatment in advance, as solvents for coal liquefaction, the ratio of coal liquefaction was substantially invariable without reference to the presence or absence of the aforementioned side chains and, under fixed conditions, the hydrogenation proceeded faster with the aromatic substance lacking the side chains than with the aromatic substance possessing such side chains.

These results contradict the electron theory which favors a conclusion that the hydrogenation proceeds more readily on the aromatic substance which contains side chains such as methyl groups and, therefore, possesses polarity. A possible reason for this contradiction may be that since this reaction actually proceeds in the presence of a catalyst, the side chains cause the phenomenon of steric hindrance on the surface of the catalyst and, consequently, impede the hydrogenation reaction.

Then the portion of the heavy oil resulting from the coal liquefaction which boiled at temperatures of not less than 200° C. was subjected to a hydrogenation treatment and the product of the hydrogenation was divided into a fraction boiling at 200° to 210° C., a fraction boiling at 211° C. to 250° C. and a fraction boiling at temperatures of not less than 251° C., and these fractions were investigated.

The results revealed that the fraction boiling at 200° to 210° C. came to abound with a hydrogen-donating content in consequence of the first round of the hydrogenation treatment, whereas the fraction boiling at 211° to 250° C. acquired no hydrogen-donating content unless it was subjected to a second round of a hydrogenation treatment. The results suggested that when the fraction boiling at 200° to 210° C. which has undergone the first round of a hydrogenation treatment and the fraction boiling at 211° to 250° C. which has undergone the two rounds of a hydrogenation treatment were mixed, the resultant mixture would serve advantageously as a solvent for the coal liquefaction.

It was found, however, that when the coal was converted into slurry by addition of this mixed solvent, the slurry was in a poor condition because it suffered from solid-liquid phase separation. It was ascertained that this phase separation was ascribable to the fact that the mixed solvent consisting of the fraction boiling at 200° to 210° and the fraction boiling at 211° to 250° C. and undergone the hydrogenation treatment in advance possessed a notably lower viscosity than the solvent conventionally used for the coal liquefaction and the fact that the mixed solvent abounded with the hydrogen-donating content and, therefore, possessed a relatively low level of aromaticity and exhibited inferior affinity for coal, a substance rich in aromaticity.

The inventors, therefore, continued to search for a method for adding to the slurry a suitable amount of the fraction boiling at temperatures of not less than 251° C. and possessing a high viscosity and a relatively high aromaticity. It was consequently established that the addition of the fraction provided notable improvement in the state of the formed slurry and gave a solution to the problem of solid-liquid phase separation.

The fraction boiling at temperatures of not less than 251° C., however, possessed virtually no hydrogen-donating property. When this fraction was mixed in a large amount with the fraction boiling at 200° to 210° C. or the fraction boiling at 211° to 250° C. which had undergone the hydrogenation treatment in advance, therefore, the resultant mixed solvent had its overall hydrogen-donating property lowered. When the mixing ratio of the solvent to the coal (the mixing ratio of the solvent to the coal taken as the unity) fell within the prevalent range of from 1 to 5, the conversion of coal liquefaction was notably lowered as the content of the fraction boiling at temperatures of not less than 251° C. increased past 50% of the mixed solvent. This clearly indicates that the content of the fraction boiling at temperatures of not less than 251° C. ought to be not more than 50% of the mixed solvent. At the mixing ratio 5, for example, the liquefaction of coal was obtainable even if the content of the fraction boiling at temperatures of not less than 251° C. accounted for 50%. At a mixing ratio within the range of from 3 to 1, however, the conversion could be prevented from possible decline by bringing the content of the fraction boiling at temperatures of not less than 251° C. to a lower percentage.

Before the heavy liquid obtained by the liquefaction of coal was subjected to the first round of the hydrogenation treatment, the portion boiling at temperatures of not less than 200° C. was divided into a fraction boiling at 200° to 210° C., a fraction boiling at 211° to 250° C. and a fraction boiling at temperatures of not less than 251° C. and these fractions were studied.

The results revealed that when the product obtained by hydrogenating the fraction boiling at 211° to 250° C. was subjected to another hydrogenation and the product of the second hydrogenation was mixed with the fraction boiling at 200° to 210° C., there was obtained a large amount of the mixed solvent for coal liquefaction which excelled in hydrogen-donating ability. At the mixing ratio of 5, for example, the liquefaction of coal could be obtained even when the content of the fraction boiling at temperatures of not less than 251° C. was as high as 50%. At a mixing ratio within the range of from 3 to 1, possible decline in the conversion of coal liquefaction could be prevented by suitably lowering the content of the fraction boiling at temperatures of not less than 251° C.

A further understanding of the present invention will be obtained by reference to the attached drawings taken in conjunction with the following discussion.

FURTHER DESCRIPTION OF THE PREFERRED EMBODIMENTS

Various possible embodiments of the equipment useful in achieving the process of this invention are shown in the accompanying drawings, wherein like parts are indicated by like numeric symbols.

Figure 1:
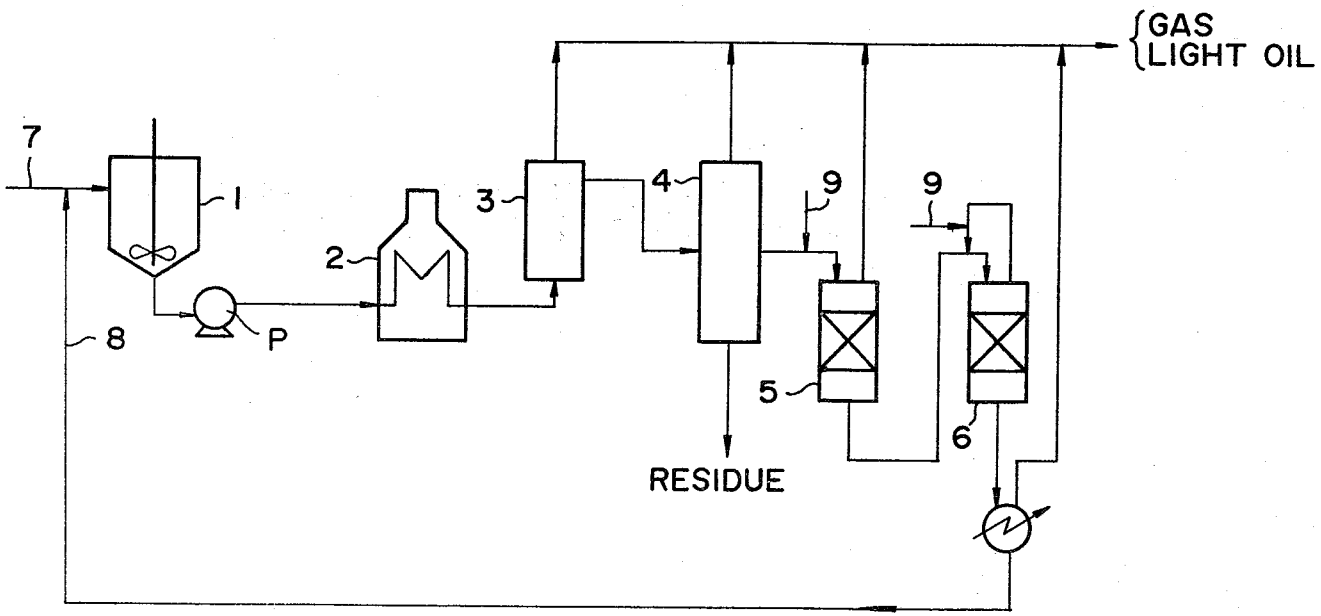
FIG. 1 shows a block diagram illustrating one preferred embodiment of the equipment to be used for effecting the process of this invention.

In FIG. 1, an agitation tank 1 is used for mixing coal from line 7 and the solvent from line 8 into slurry, a heating furnace 2 is used for elevating the temperature of the slurry to a prescribed level, the slurry passing on to a dissolver 3, a distillation tower 4, and hydrogenation towers 5 and 6. In this arrangement, the coal from line 7 and the from line 8 are agitated in the agitation tank 1 to form slurry and the slurry is conveyed by a pump P into the heating furnace 2. The hot slurry which has been heated to the prescribed level in this furnace is kept in the dissolver 3 until the reaction is completed. The gas which is liberated within the dissolver is discharged through the top and separated. The liquid product remaining within the dissolver overflows the tank's discharge port and enters the distillation tower 4, in which the reaction product is divided into a light-weight portion boiling at temperatures of less than 200° C., a reaction product boiling at temperatures of not less than 200° C. and unreacted solidous residue. Then, the reaction product boiling at temperatures of not less than 200° C. is introduced in conjunction with hydrogen gas from line 9 into the hydrogenation tower 5 where it is subjected to a hydrogenation treatment. The hydrogenated product is introduced in conjunction with hydrogen gas from line 9 into the other hydrogenation tower 6, where it is subjected once again to a hydrogenation treatment. The product of the second hydrogenation treatment is recirculated as a solvent to the site of coal liquefaction. The unreacted hydrogen gas from line 9 is also used cyclically.

Figure 2:
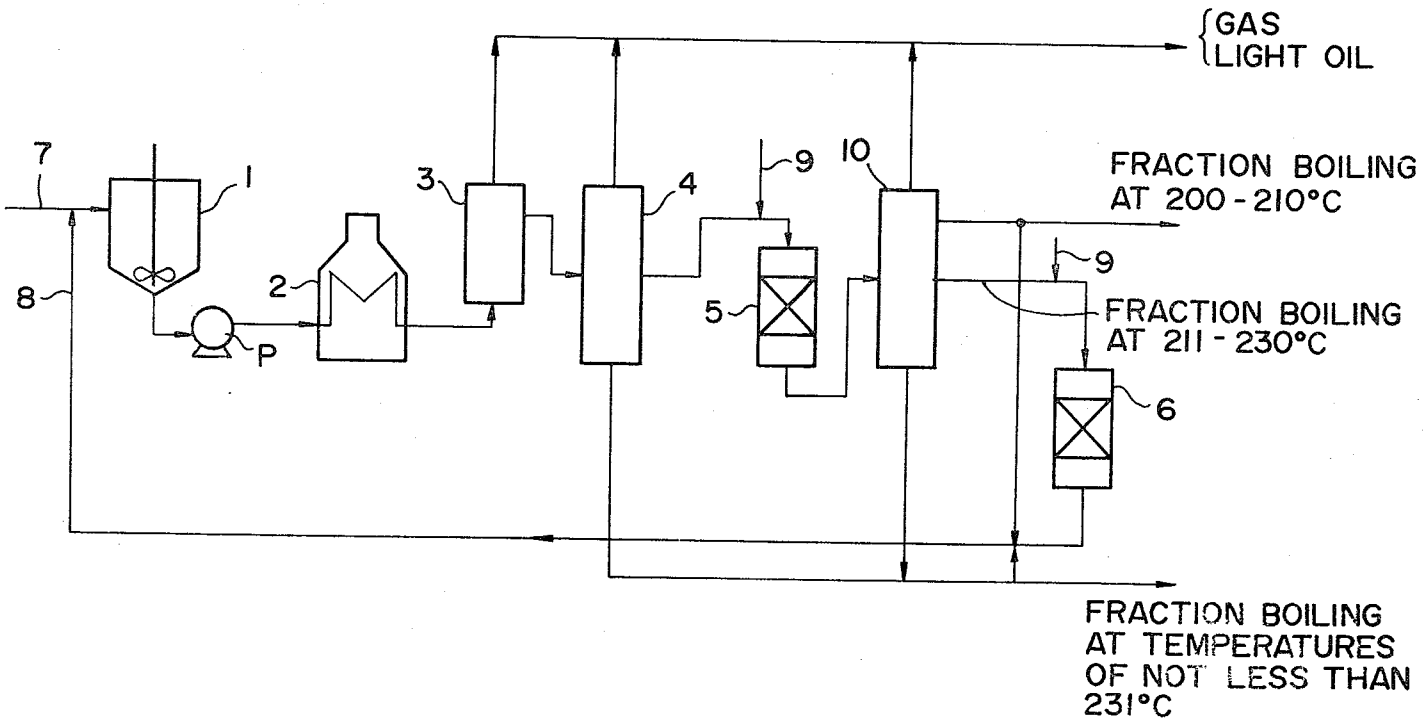
FIG. 2 shows a block diagram illustrating another preferred embodiment of the present invention.

In the equipment of FIG. 2, another distillation tower 10 is disposed between the hydrogenation towers 5 and 6. In this distillation tower 10, the reaction product is divided into gas and light oil fraction boiling at temperatures of less than 200° C., a fraction boiling at 200° to 210° C., a fraction boiling at 211° to 230° C. and a fraction boiling at temperatures of not less than 231° C. The separated fraction boiling at 211° to 230° C. is introduced into the hydrogenation tower 6 where it is subjected to a hydrogenation treatment. The fraction boiling at 211° to 230° C. which has departed from the hydrogenation tower is mixed with the fraction boiling at 200° to 210° C. and the fraction boiling at temperatures of not less than 231° C. and the resultant mixture is circulated as a solvent to the site of coal liquefaction.

Figure 3:
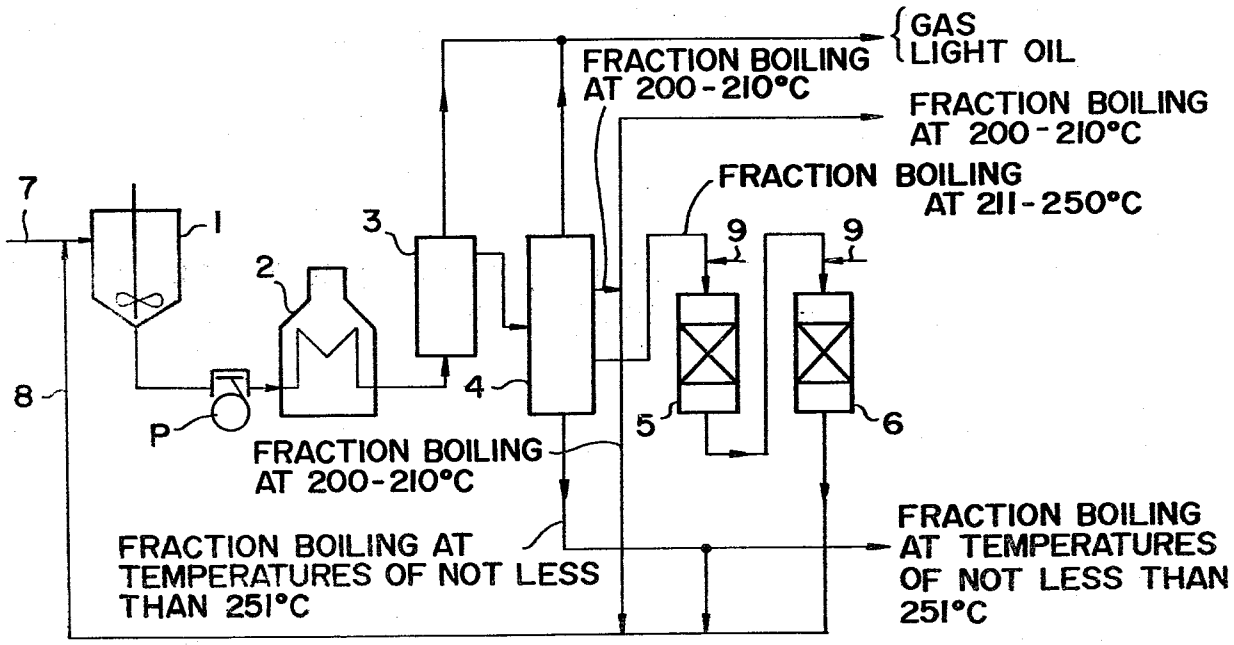
FIG. 3 shows a block diagram illustrating yet another preferred embodiment of the present invention.

In the equipment of FIG. 3, the reaction product of coal liquefaction is divided in the distillation tower 4 into gas and light oil fraction boiling at temperatures or less than 200° C., a fraction boiling at 200° to 210° C., a fraction boiling at 211° to 250° C., and a fraction boiling at temperatures of not less than 251° C. The fraction boiling at 211° to 250° C. is subjected to a hydrogenation treatment in the hydrogenation towers 5, 6. The product of the two rounds of hydrogenation treatment is mixed with the fraction boiling at 200° to 210° C. and the fraction boiling at temperatures of not less than 251° C. and the resultant mixture is circulated as a solvent to the site of coal liquefaction.

The invention will now be described with reference to working examples.

EXAMPLE 1

In a rotary autoclave having an inner volume of 5 liters, coal having a composition shown in Table 1 was hydrogenated in the absence of a solvent at a reaction temperature of 450° C., a reaction time 240 minutes, and an initial hydrogen pressure of 100 Kg/cm$^2$ G. After the completion of the reaction, the reaction product was subject to shaken extraction with 20 liters of benzene at normal room temperature for 10 hours, and the resultant extract was suction filtered through a glass filter (pore size 5 to 10 μm) to obtain a filtrate (soluble in benzene) and a residue (insoluble in benzene). The filtrate thus obtained was divided in the distillation tower under normal pressure into a portion boiling at temperatures of less than 200° C. and a portion boiling at temperatures of not less than 200° C., affording a liquefied heavy oil boiling at temperatures of not less than 200° C.

This trial hydrogenation of coal in the absence of a solvent was performed on a sample size of 1 kg/batch. Under the fixed reaction conditions, a total of five trial hydrogenations were performed to liquefy 5 kg of coal. The yield of the product obtained as the average of the results of five trial hydrogenations is shown in Table 2.

In an autoclave having an inner volume of 500 ml and adapted to provide desired agitation of its contents by electromagnetic induction, the liquefied heavy oil (hereinafter referred to as "fraction I") obtained in consequence of the aforementioned trial hydrogenation was hydrogenated in the presence of a Co-Mo catalyst at a reaction temperature of 400° C. a reaction time of 60 minutes and an initial hydrogen pressure of 70 Kg/cm$^2$ G, to afford a hydrogenated heavy oil (hereinafter referred to as "fraction I'").

Subsequently, the fraction I was placed in the same autoclave having an inner volume of 500 ml and adapted to provide desired agitation by electromagnetic induction and subjected to dealkylation in the presence of a Cr catalyst at a reaction temperature of 450° C., a reaction time of 60 minutes and an initial hydrogen pressure of 30 Kg/cm$^2$ G, to afford a dealkylated heavy oil (hereinafter referred to as "fraction II"). The fraction II was treated under the same conditions as those under which the fraction I was hydrogenated, to afford a hydrogenated dealkylated heavy oil (hereinafter referred to as "fraction II'").

In an autoclave having an inner volume of 500 ml., coal of the composition of Table 1 was subjected to trial liquefaction, with the fractions I, I', II and II'' used separately as a solvent a reaction temperature of 400° C., a reaction time of 60 minutes, an initial hydrogen pressure of 70 Kg/cm$^2$ G mixing ratio (mixing ratio of the solvent to the coal taken as the unity) of 5. The products of the liquefaction were extracted with benzene and were analyzed for conversion. The results are shown in Table 3.

It is noted from the results of Table 3 that the conversions of coal liquefaction were low when the fraction I of heavy oil which had been hydrogenated in the absence of a solvent and the fraction II of dealkylated heavy oil were used as the solvent, whereas the conversions were high when the fraction I' obtained by the hydrogenation of the fraction I and the fraction II' obtained by the hydrogenation of the fraction II were used as the solvent. Clearly the conversion was highest when the fraction II' of hydrogenated, dealkylated heavy oil was used as the solvent. Thus, it is highly advantageous to subject the heavy oil to a dealkylation treatment in advance, then subject the dealkylation product to a hydrogenation treatment and use the hydrogenation product as the solvent for coal liquefaction as contemplated by the present invention.

TABLE 1

| Elementary analysis (daf %) | | | | | Volatile | Ash |
|---|---|---|---|---|---|---|
| C | H | N | S | O diff. | matter (%) | content (%) |
| 76.8 | 6.9 | 1.3 | 0.2 | 14.8 | 37.3 | 9.8 |

TABLE 2

| Product | Gas | Fraction boiling less than 200° C. | Fraction boiling not less than 200° C. | Filtration residue |
|---|---|---|---|---|
| Yield (%) | 15.2 | 9.1 | 61.3 | 17.9 |

TABLE 3

| | Solvent | | | |
|---|---|---|---|---|
| | I | I' | II | II' |
| Conversion (%) | 38.2 | 49.8 | 36.5 | 75.4 |

EXAMPLE 2

Coal of the same composition as used in Example 1 was treated under the same conditions as those of Example 1 to obtain a liquefied heavy oil boiling at temperatures of not less than 200° C.

In the same test apparatus as used in Example 1, the heavy oil was subjected to a dealkylation in the presence of a Cr catalyst at a reaction temperature of 450° C., a reaction time of 60 minutes and an initial hydrogen pressure at 30 Kg/cm$^2$ G. The product of the dealkylation was divided in a distillation tower under normal pressure into a light fraction boiling at temperatures of less than 200° C., a fraction boiling at 200° to 210° C. (hereinafter referred to as "fraction III"), a fraction boiling at 211° to 230° C. (hereinafter referred to as "fraction IV") and a fraction boiling at temperatures of not less than 231° C. (hereinafter referred to as "fraction V"). Then, in an autoclave having an inner volume of 500 ml and adapted to provide desired agitation by electromagnetic induction, the fractions III, IV and V obtained as described above were separately subjected to a hydrogenation treatment in the presence of a Co-Mo catalyst at a reaction temperature 400° C., a reaction time of 60 minutes and an initial hydrogen pressure of 70 Kg/cm$^2$ G to afford products III', IV' and V' of hydrogenation.

The coal of the aforementioned composition of Table 1 was subjected to a trial liquefaction, with the fractions III, IV, V, III', IV' and V' used separately as the solvent at a reaction temperature of 400° C., reaction time of 60 minutes, an of initial hydrogen pressure of 70 Kg/cm$^2$ G and a mixing ratio of 5. The products of the hydrogenation treatment were extracted with benzene and then analyzed for conversions. The results are shown in Table 4.

It is noted from Table 4 that use of the fraction III gave a highly desirable conversion, suggesting that the fraction III, though not subjected to the hydrogenation treatment, can be used satisfactorily as the solvent for coal liquefaction. It is also noted that among the hydrogenated fractions III', IV' and V' used in the coal liquefaction, the fractions III' and IV' gave high conversions. Particularly the conversion obtained by the fraction IV', when compared with the low conversion of only 24.5% obtained by the fraction IV (unhydrogenated countertype of the fraction IV'), clearly implies that the hydrogenation treatment brought about a startling increase in the conversion. In the case of the fraction III', the fact that the conversion obtained by the fraction III (the unhydrogenated countertype of the fraction III) rose past 80% implies that the hydrogenation treatment was not necessary and, in fact, was not effective.

When the fraction III is mixed with the fraction IV' obtained by the hydrogenation of the fraction IV and the resultant mixture is used as the solvent for coal liquefaction, therefore, the conversion of the coal liquefaction is expected to rise to a high level.

TABLE 4

| | Solvent | | | | | |
|---|---|---|---|---|---|---|
| | III | IV | V | III' | IV' | V' |
| Conversion (%) | 81.0 | 24.5 | 25.2 | 81.9 | 83.3 | 47.0 |

EXAMPLE 3

Of the fractions obtained in Example 2, the fraction III was mixed with the fraction IV' and the resultant mixture was mixed with a varying amount of the fraction V. Then coal of the same composition as shown in Table 1 was subjected to a trial liquefaction in an autoclave having an inner volume 500 ml. and adapted to provide desired agitation by electromagnetic induction, with the mixed fractions separately used as the solvent, at a reaction temperature of 400° C., a reaction time of 60 minutes, an initial nitrogen pressure of 70 Kg/cm$^2$ G mixing ratio of 5. The products of the hydrogenation were extracted with benzene and then analyzed for conversion. The results are shown in Table 5.

It is seen from Table 5 that the conversions of coal liquefaction were low when the contents of the III+IV' mixture in the solvents used were low, whereas the conversions were around the desirable level of 80% where the contents of the III+IV' mixture in the solvents exceeded 60%. From the results, it is inferred that even at the mixing ratio of 5, the content of the III+IV' mixture in the solvent ought to be greater than 50% in order to obtain a high conversion of the coal liquefaction.

TABLE 5

| Solvent composition (%) | III + IV' | 0 | 20 | 40 | 50 | 60 | 80 | 100 |
|---|---|---|---|---|---|---|---|---|
| | V | 100 | 80 | 60 | 50 | 40 | 20 | 0 |
| Conversion (%) | | 25.2 | 31.3 | 49.9 | 71.5 | 78.5 | 81.6 | 83.0 |

EXAMPLE 4

In a test apparatus adapted to permit supply of slurry at a flow velocity of 2 l/hr under increased pressure, varying slurries prepared by using the solvents obtained Example 2 were treated separately at room temperature and 50 kg/cm$^2$ of pressure. The properties of the slurries before and after the treatment are shown in Table 6.

It is clear from Table 6 that in the case of slurries prepared by using only the III+IV' mixture as the solvent, the mixing ratios of the solvent to the coal notably rose after the treatment, suggesting that during the passage through the apparatus the slurries underwent solid-liquid phase separation and the solid phases of coal powder sedimented and remained within the apparatus. In the case of the slurries prepared by using the mixtures incorporating the fraction V as the solvent, the mixing ratios of the solvent to the coal were substantially invariable before and after the treatment, indicating that the incorporation of the fraction V was highly effective in stabilizing the slurries.

TABLE 6

| Run No. | Solvent composition (%) III + IV' | Solvent composition (%) V | Solvent/coal ratio Before treatment | Solvent/coal ratio After treatment |
|---|---|---|---|---|
| 1 | 0 | 100 | 5 | 5.0 |
| 2 | 50 | 50 | 5 | 5.0 |
| 3 | 90 | 10 | 5 | 5.3 |
| 4 | 100 | 0 | 5 | 7.8 |
| 5 | 90 | 10 | 1 | 1.0 |

EXAMPLE 6

In a rotary autoclave having the same inner volume as the autoclave used in Example 1, liquefaction of coal in the absence of a solvent was tried under the same conditions as those of Example 1. After completion of the reaction, a portion of the gas produced within the autoclave was gathered and was analyzed. The residue in the autoclave was fractionated in a distillation tower under normal pressure into a fraction boiling at temperatures of less than 200° C. (hereinafter referred to as "fraction VI"), a fraction boiling at 200° to 210° C. (hereinafter referred to as "fraction VII"), a fraction boiling at 211° to 230° C. (hereinafter referred to as "fraction VIII"), a fraction boiling at 231° to 250° C. (hereinafter referred to as "fraction IX") and a fraction boiling at temperatures of not less than 251° C. (hereinafter referred to as "fraction X"). The numbers of the non-solvent hydrogenation tests conducted on the coal and the conditions used for the tests were identical to those used in Example 1. The average yields of the resultant products are shown in Table 7.

Of the fractions obtained as described above, 1/5 portions were collected each from the fractions VII, VIII, IX and X and were mixed to form a fraction boiling at temperatures of not less than 200° C. and 1/5 portions were collected each from the fractions VIII and IX and were mixed to form a fraction boiling at 211° to 250° C. (hereinafter referred to as "fraction XI"). The two solvents prepared as just described were separately subjected to a dealkylation treatment in the presence of a Cr catalyst in the same test apparatus as used in Example 1, at a reaction temperature of 450° C., a reaction time of 60 minutes and an initial hydrogen pressure of 30 Kg/cm$^2$ G. The products of the dealkylation were fractionated in a distillation tower under normal pressure into similar fractions to those described above. The yields (%) of the fractions based on the coal as the starting material (on dry and ash free basis) are shown in Table 8.

It is clear from the results of Table 8 that when the fraction boiling at temperatures of not less than 200° C. (VII+VIII+IX+X) or the fraction boiling at 211° to 250° C. (VIII+IX or the fraction XI) was dealkylated, the amount of the fraction VII+VIII increased to 21.0 or 18.1%, respectively, compared with the original yield obtained after the liquefaction (14.5%—Table 7). Particularly in the case of the fraction XI, the total amount of the fraction VII+VIII incorporating the amount 3.3% of the original fraction VII rose to 21.4%. Thus, the amount of the fraction VII+VIII thus obtained was equal to or greater than that obtained by dealkylating the fraction boiling at temperature of not less than 200° C.

TABLE 7

| | Product Gas | VI | VII | VIII | IX | X |
|---|---|---|---|---|---|---|
| Yield (%) | 19.5 | 13.9 | 3.3 | 11.2 | 9.4 | 46.8 |

TABLE 8

| | Starting material | Gas + VI | VII + VIII | IX + X |
|---|---|---|---|---|
| Yield (%) | VII + VIII + IX + X | 3.4 | 21.0 | 46.3 |
| | VIII + IX | 0.9 | 18.1 | 1.6 |

EXAMPLE 7

In a shaken autoclave having an inner volume of 500 ml, the fraction VI, the fraction X and the fraction obtained by dealkylating the fraction XI (hereinafter referred to as "fraction XI$_O$") were separately subjected to a hydrogenation treatment in the presence of a Co-Mo catalyst at a reaction temperature of 400° C., a reaction time of 60 minutes and an initial hydrogen pressure of 70 Kg/cm$^2$ G, to afford hydrogenated fractions VII', XI$_O$' and X'. With the fraction VII', XI$_O$' and X' and their respective original fractions VII, IX$_O$ and X used separately as the solvent, coal was subjected to a trial liquefaction at a reaction temperature of 400° C., reaction time of 60 minutes, and an initial hydrogen pressure of 70 Kg/cm$^2$ G and 5 a mixing ratio of 5. The products of the liquefaction were extracted with benzene and analyzed for conversions. The results thus obtained are shown in Table 9.

It is noted from the results of Table 9 that use of the fraction VII as the solvent gave a remarkably high conversion of coal liquefaction, suggesting that the fraction VII can be used satisfactorily as the solvent for coal liquefaction without requiring any hydrogenation.

It is further noted that among the solvents of VII', $VI_O'$ and X', the first two solvents gave high conversions of coal liquefaction. Particularly the conversion obtained by the fraction $XI_O'$, when compared with the low conversion of only 24.9% obtained by the original fraction $XI_O$, clearly implies that the hydrogenation treatment brought about at a startling increase in the conversion. In the case of the fraction VII', the fact that the conversion obtained by the original fraction VII rose past 80% implies that the hydrogenation treatment was not necessary and, in fact, was not effective.

When the fraction VII is mixed with the fraction $XI_O'$ obtained by hydrogenating the fraction $XI_O$ and the resultant mixture is used as the solvent for coal liquefaction, therefore, the conversion of the coal liquefaction is expected to rise to a high level.

TABLE 9

| | Solvent | | | | | |
|---|---|---|---|---|---|---|
| | VII | $XI_O$ | X | VII' | $XI_O'$ | X' |
| Conversion (%) | 81.0 | 24.9 | 25.4 | 81.9 | 82.3 | 44.7 |

EXAMPLE 8

Of the fractions obtained in Example 6, the fraction VII was mixed with the fraction $XI_O'$ and the resultant mixture was mixed with a varying amount of the fraction X. Then, the coal was subjected to a trial liquefaction in a shaken autoclave having an inner volume of 500 ml, with the mixed solvents separately used as the solvent, at a reaction temperature of 400° C., a reaction time of 60 minutes, an initial nitrogen pressure of 70 Kg/cm$^2$ G a mixing ratio of 5. The products of the liquefaction were extracted with benzene and analyzed for conversions. The results are shown in Table 10.

It is seen from Table 10 that the conversions were low where the contents of the VII+$XI_O$ mixture in the solvents used were low, whereas the conversions were around the desirable level of 80% where the same contents were 60% or over, suggesting that when the mixing ratio is fixed at 5, the content of the VII+$XI_O'$ fraction in the solvent ought to be greater than 50% in order to obtain a high conversion of coal liquefaction.

Then, in a test apparatus adapted to permit supply of slurry at a flow velocity of 2 l/hr under increased pressure, slurries prepared by using, among the mixed solvents shown in Table 10, typical ones were treated separately at normal room temperature and 50 kg/cm$^2$ G of pressure. The properties of the slurries before and after the treatment are also shown in Table 10.

It is clear from the results of Table 10 that in the case of slurries prepared by using only the VII+$XI_O'$ mixture as the solvent, the mixing ratios of the solvent to the coal notably rose after the treatment, suggesting that during the passage through the apparatus the slurries underwent solid-liquid phase separation and the solid phases of coal powder sedimented and remained within the apparatus. On the other hand, in the case of slurries prepared by using the mixtures incorporating the fraction X as the solvent, the mixing ratios of the solvent to the coal were substantially invariable before and after the treatment, indicating that the incorporation of the fraction X was highly effective in stabilizing the slurries.

| | | | | | | | | |
|---|---|---|---|---|---|---|---|---|
| Solvent composition (%) | VII + $XI_O'$ | 0 | 20 | 40 | 50 | 60 | 80 | 100 |
| | 100 | 80 | 60 | 50 | 40 | 20 | 0 | |
| Conversion (%) | | 25.4 | 30.8 | 52.3 | 70.0 | 77.8 | 81.5 | 82.0 |
| Solvent/coal ratio | Before test | — | 5 | — | 5 | — | 5 | 5 |
| | After test | — | 5.0 | — | 5.0 | — | 5.1 | 6.9 |

We claim:

1. A process for the production of a solvent for use in coal liquefaction comprising the steps of (a) separating the liquid product resulting from the liquefaction of coal into a first fraction boiling at temperatures of less than 200° C., a second fraction boiling at 200° to 210° C., a third fraction boiling at 211° to 250° C. and a fourth fraction boiling at temperatures of not less than 251° C., (b) subjecting said third fraction to a first hydrogenation treatment, (c) subjecting the hydrogenated product of step (b) to a second hydrogenation treatment, (d) mixing the hydrogenated product of step (c) with at least a part of the second fraction of step (a) to form a resultant mixture, and (e) mixing not less than 50% of said resultant mixture with not more than 50% of the fourth fraction of step (a) to form the solvent.

2. A process for the production of a solvent for use in coal liquefaction comprising the steps of (a) subjecting the liquid product obtained by coal liquefaction to a first separation treatment thereby separating the liquid product substantially into a portion boiling at temperatures of less than 200° C. and a portion boiling at temperatures of not less than 200° C., (b) subjecting the portion boiling at temperatures of not less than 200° C. to a first hydrogenation treatment, (c) subjecting the hydrogenated product of step (b) to a separation treatment to form a first fraction boiling at 200° to 210° C., a second fraction boiling at 211° to 230° C. and a third fraction boiling at temperatures of not less than 231° C., (d) subjecting said second fraction of step (c) to a second hydrogenation treatment, (d) mixing the hydrogenated product obtained in step (d) with at least a part of the first fraction obtained in step (c) to form a resultant mixture, and (e) mixing, not less than 50% of said resultant mixture with not more than 50% of the third fraction of step (c) to form the solvent.

* * * * *